US007347737B2

(12) United States Patent
Horiba

(10) Patent No.: US 7,347,737 B2
(45) Date of Patent: Mar. 25, 2008

(54) CONNECTOR HOUSING WITH INTERNAL CAPACITOR CONSTRUCTED WITH OVERLAPPING PORTIONS OF TERMINALS

(75) Inventor: Keiji Horiba, Nishikasugai-gun (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 11/185,753

(22) Filed: Jul. 21, 2005

(65) Prior Publication Data

US 2006/0030216 A1 Feb. 9, 2006

(30) Foreign Application Priority Data

Aug. 4, 2004 (JP) ..... 2004-227842

(51) Int. Cl.
*H01R 24/00* (2006.01)

(52) U.S. Cl. ..... 439/676

(58) Field of Classification Search ..... 439/620, 439/333, 941, 95, 108, 326, 676; 174/255
See application file for complete search history.

(56) References Cited

U.S. PATENT DOCUMENTS 5,219,305 A * 6/1993 Kawaguchi et al. ... 439/620.12
5,456,616 A * 10/1995 Fuerst et al. ..... 439/620.1
5,509,825 A * 4/1996 Reider et al. ..... 439/620.09
6,447,337 B1 * 9/2002 Anderson et al. ..... 439/620
6,478,626 B2 * 11/2002 Dingenotto et al. ..... 439/620
6,506,079 B1 * 1/2003 Dingenotto et al. ..... 439/620
6,678,164 B2 1/2004 Chikuan et al.
6,776,661 B2 * 8/2004 Dingenotto et al. ..... 439/620
6,872,893 B2 * 3/2005 Fukuoka et al. ..... 174/255
6,964,587 B2 * 11/2005 Colantuono et al. ..... 439/676

FOREIGN PATENT DOCUMENTS

JP A-10-256435 9/1998
JP A-2002-98552 4/2002

* cited by examiner

*Primary Examiner*—Chandrika Prasad
(74) *Attorney, Agent, or Firm*—Posz Law Group, PLC

(57) ABSTRACT

A connector housing includes a resin body and multiple metallic terminals insert-molded into the resin body. The terminals are disposed to overlap each other inside the resin body, so that a part of the resin body is sandwiched between the overlapping portions as a dielectric material. A capacitor is provided with the overlapping portions and the part of the resin body. The capacitor is capable of reducing noise.

17 Claims, 3 Drawing Sheets

CONNECTOR HOUSING WITH INTERNAL CAPACITOR CONSTRUCTED WITH OVERLAPPING PORTIONS OF TERMINALS

CROSS REFERENCE TO RELATED APPLICATION

This application is based on Japanese Patent Application No. 2004-227842 filed on Aug. 4, 2004, the disclosure of which is incorporated herein by reference.

FIELD OF THE INVENTION

The present invention relates to a connector housing capable of preventing noise.

BACKGROUND OF THE INVENTION

A connector housing formed by insert molding multiple metallic terminals into a resin body has been used for a sensor connector, an ECU connector and the like. Such connectors have external capacitors almost directly connected to the terminals (refer to, for example, Japanese Patent Application Publication No. H10-256435, Japanese Patent Application Publication No. 2002-98552, and Japanese Patent Application Publication No. 2003-294558, which corresponds to U.S. Pat. No. 6,678,164). The capacitors serve to reduce noise, for example, an electromagnetic wave and static electricity.

A connector housing incorporating such capacitors is shown in FIG. 4. In the connector housing, multiple metallic terminals 20 are insert-molded into a resin body 10. Surface mount capacitors 200 as a noise filter are mounted on the terminals 20 through a conductive adhesive member 210. The capacitors 200 can be mounted on the terminals 20 either before or after the terminals 20 are insert-molded into the resin body 10.

However, manufacturing cost of the connector housing increases because of an additional cost of the capacitors 200 and an extra process of mounting the capacitors 200.

Further, in the connector housing, the stability of electrical connection between the capacitors 200 and the metallic terminals 20 is low, because the conductive adhesive member 210 has insufficient adhesive force.

SUMMARY OF THE INVENTION

In view of the above-described problem, it is an object of the present invention to provide a connector housing, which is formed by insert molding multiple metallic terminals into a resin body, eliminating noise such as an electromagnetic wave and static electricity without external capacitors. Inside the resin body, the terminals overlap each other so that capacitors are constructed with the overlapping portions. The capacitors are capable of eliminating noise such as an electromagnetic wave and static electricity, and therefore, external capacitors are not required. As a result, mounting process of the external capacitors can be omitted.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1A:
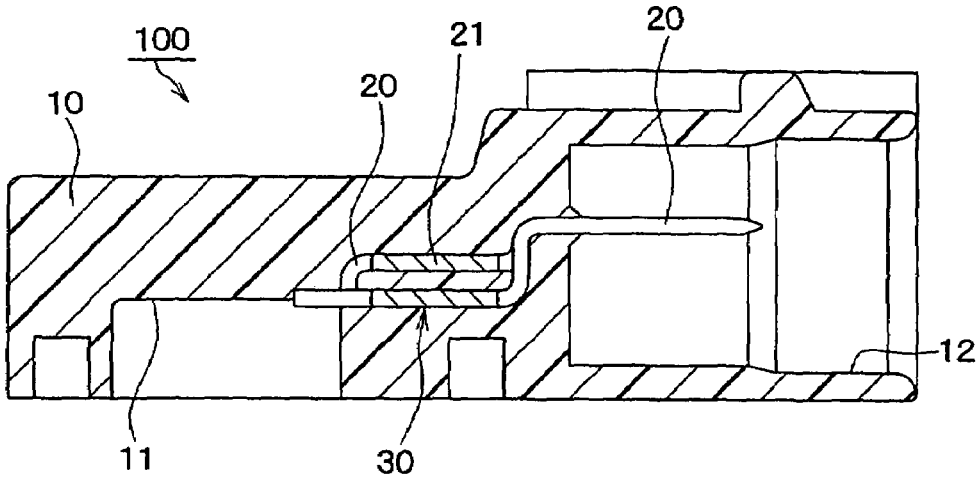
FIG. 1A is a schematic cross sectional view showing a connector housing according to an embodiment of the present invention.
Figure 1B:
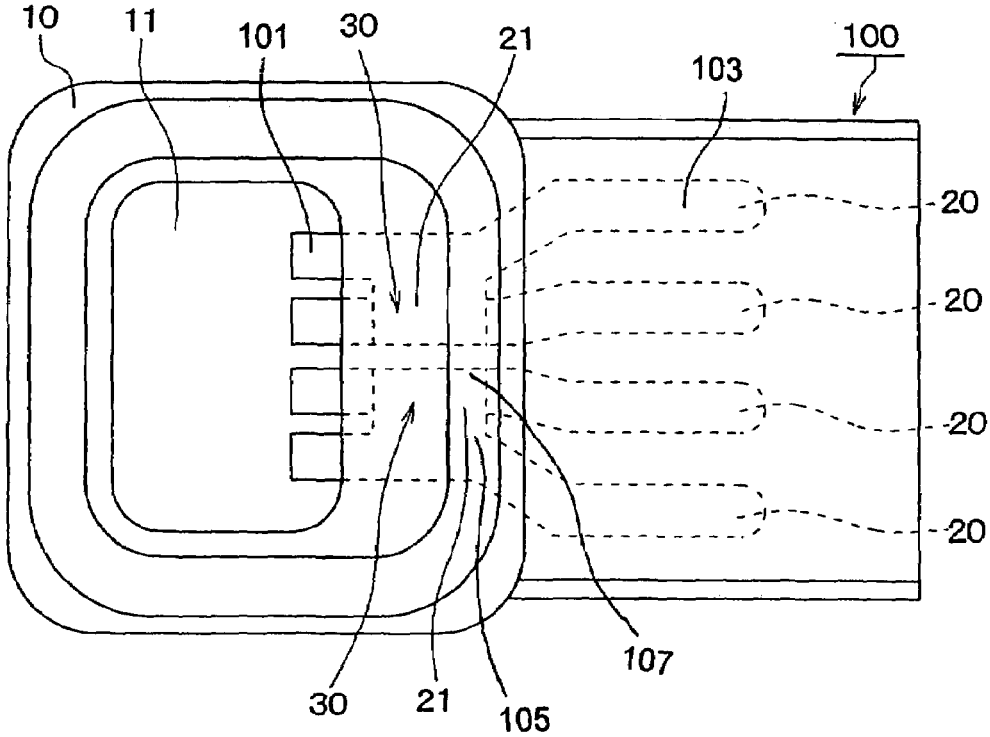
FIG. 1B is a schematic plan view of FIG. 1A.

A connector housing 100 according to an embodiment of the present invention is shown in FIGS. 1A to 1B. The housing 100 has a multitude of uses. For example, the housing 100 can be used as a connector housing for a pressure sensor. The housing 100 is formed by insert molding multiple metallic terminals 20 into a resin body 10. The resin body 10 is made of polybutylene terephthalate (PBT) or the like. The terminals 20 are made of a conductive metallic material such as copper and Alloy42 (FeNi42). Alloy42 (FeNi42) means iron alloy containing 42% nickel.

As shown in FIG. 1A, a hollow area 11 is formed on one surface of the resin body 10. Inside the area 11, for example, a diaphragm-type pressure-sensing element can be accommodated and fixed there. An opening 12 is formed on another surface of the resin body 10.

Each terminal 20 is exposed to the hollow area 11 at one end 101, and exposed to the opening 12 at the other end 103. The rest of the exposed potions of each terminal 20 are embedded into the resin body 10. At the end exposed to the area 11, for example, the terminals 20 are electrically connected to a pressure-sensing element of a pressure sensor by wire bonding. At the end exposed to the opening 12, the terminals 20 are electrically connected to a connector from an external device.

As shown in FIGS. 1A to 1B, only inside the resin body 10, the terminals 20 overlap each other so that capacitors are constructed with each overlapping portion 30. Specifically, adjacent terminals 20 are paired and arranged at different heights only inside the resin body 10. In each pair of the terminals 20, one terminal 20 has an extending section 21 extending from end 105 to end 107 toward the other terminal 20, so that the one terminal 20 overlaps the other terminal 20 at the extending section 21. Thus, the overlapping portions 30 are formed and capacitors are constructed with each overlapping portion 30 sandwiching therebetween a part of the resin body 10 as a dielectric material.

The capacitors provide a noise reduction filter just as external capacitors used in a conventional connector housing. In the connector housing 100, therefore, noise such as an electromagnetic wave and static electricity can be reduced without the external capacitors. Mounting process of the external capacitors can be omitted as a result.

In the connector housing 100, capacitance of the capacitors constructed with each overlapping portion is a few picofarad, when the resin body 10 made of polybutylene terephthalate (PBT) or the like is used as a dielectric material, facing area of the overlapping portions 30 is 5 $mm^2$ and separation distance between the terminals 20 forming the overlapping positions 30 is 3 mm. Higher capacitance can be obtained by reducing the separation distance, but risk of short-circuits between the terminals 20 increases accordingly.

Figure 2:
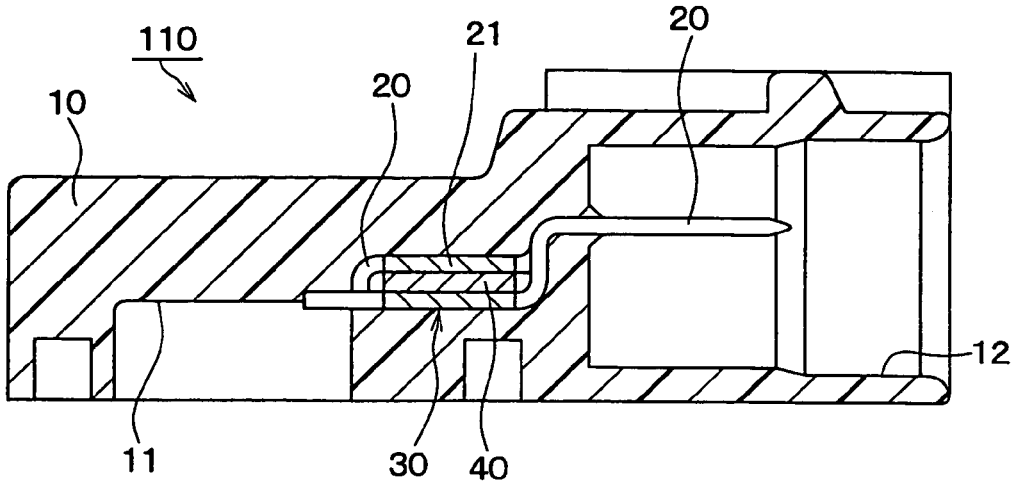
FIG. 2 is a schematic cross sectional view showing a modification of the connector housing shown in FIGS. 1A to 1B.

A connector housing 110 shown in FIG. 2 is a modification of the housing 100. In the housing 110, a dielectric member 40 made of a dielectric material is sandwiched between the terminals 20 at the overlapping portions 30 in place of the resin body 10. The dielectric member 40 has a higher dielectric constant than the resin body 10. Higher capacitance can therefore be achieved without reducing the separation distance between the terminals 20 at the overlapping portions 30. The risk of short-circuits can be eliminated as a result.

The dielectric member 40 is made of Titanium dioxide ($TiO_2$) or the like, which have a higher dielectric constant than the resin body 10. To form the housing 110, the terminals 20 sandwiching the dielectrics 40 therebetween are insert-molded into resin body 10.

Likewise, the dielectric member 40 can be positioned between the terminals 20 by the methods described below.

In one method, an adhesive material containing powder of the dielectric material, which is used as a material for the dielectric member 40, is applied on the facing surfaces of the overlapping portions 30 and hardened. Then, the terminals 20 are inserted molded into the resin body 30. In the other method, the powder of the dielectric material is added in a material for forming the resin body 10, and thereby the resin body 10 containing the powder of the dielectric material is positioned between the overlapping portions 30 after insert molding.

Figure 3:
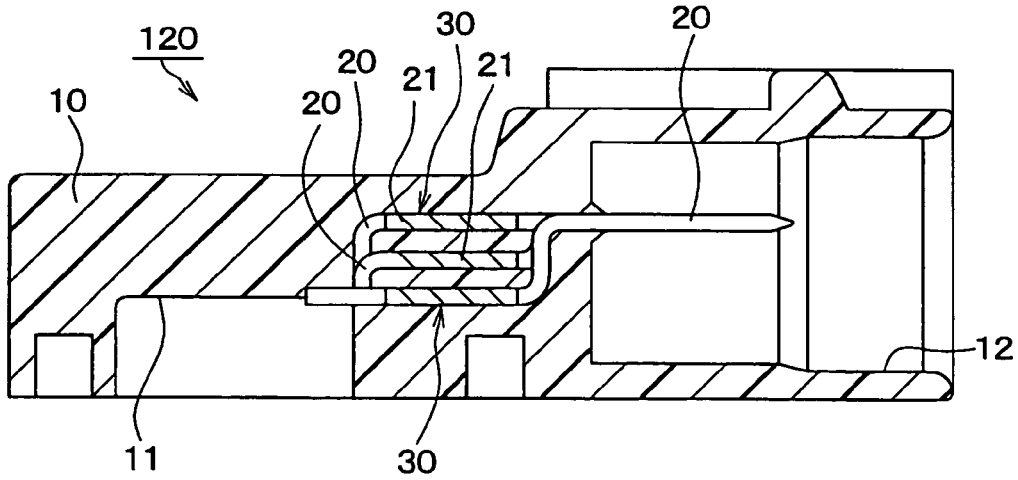
FIG. 3 is a schematic cross sectional view showing another modification of the connector housing shown in FIGS. 1A to 1B.
Figure 4:
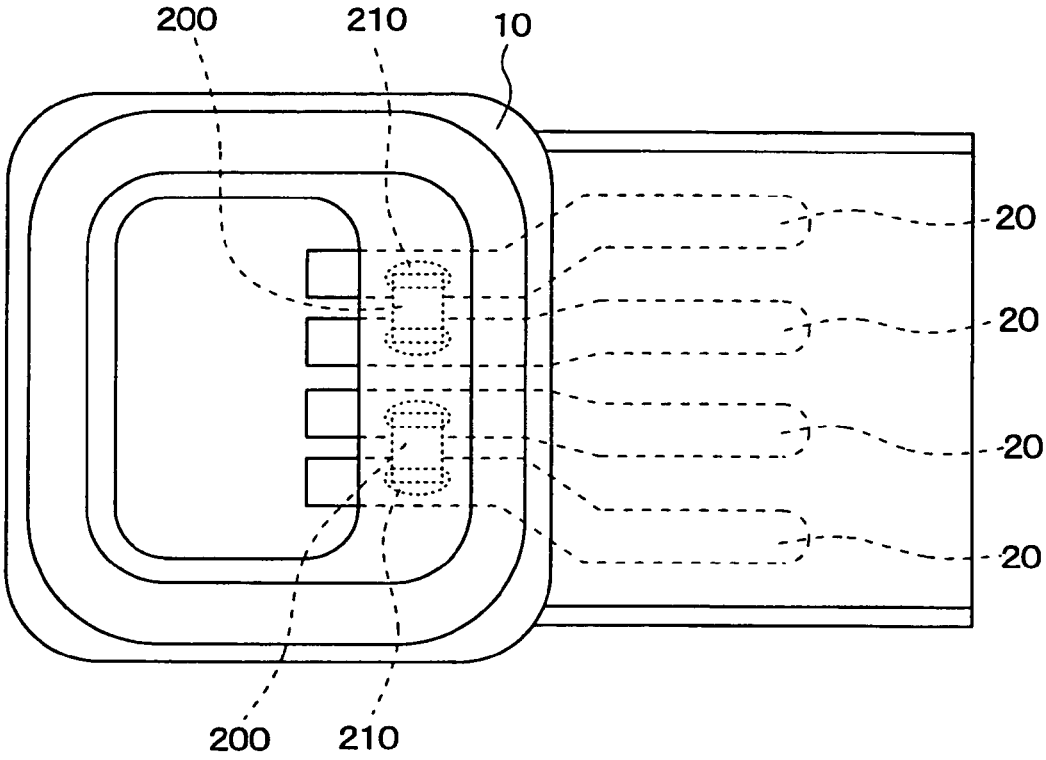
FIG. 4 PRIOR ART
FIG. 4 is a schematic plan view showing a conventional connector housing having external capacitors.

A connector housing 120 shown in FIG. 3 is another modification of the housing 100. As mentioned above, in the housing 100, one overlapping portion 30 is formed by one pair of the terminals 20, i.e. the two terminals 20. On the other hand, in the housing 120, one overlapping portion 30 is formed by three terminals 20. Specifically, the three terminals 20 are stacked on top of each other with a gap and thereby construct a kind of multilayer capacitor. Therefore, high capacitance of the capacitor can be achieved in the housing 120. If much higher capacitance is required, four or more terminals 20 can be stacked with a gap.

The housing 120 has another advantage. When the connector housing 120 is used for a pressure sensor, pressure sensing element accommodated in a hollow area 11 needs three terminals 20, i.e. for output, ground and power. In this case, two capacitors are generally required for noise reduction. One capacitor is coupled between the terminals 20 for output and for ground, and the other capacitor is coupled between the terminals 20 for power and for ground. In the housing 120, if the top, middle and bottom terminals 20 are used as a power, ground and output terminal, respectively, the two capacitors suitable for the pressure sensing element can be formed.

The uses of the connector housing according to the present invention are not limited to a sensor connector. For example, the connector housing can be applied to an ECU connector, and noise reduction filters mounted on printed-circuit board of the ECU can be greatly reduced as a result.

Such changes and modifications are to be understood as being within the scope of the present invention as defined by the appended claims.

What is claimed is:

1. A connector housing for electrically connecting a first device and a second device, comprising:

a resin body;

a plurality of conductive metallic terminals insert molded in the resin body, wherein a first end of each terminal is exposed at a first surface of the resin body to be connectable to the first device, and a second end of each terminal is exposed at a second surface of the resin body to be connectable to the second device, an overlapping portion is disposed on at least one of the terminals and is unitary with the at least one terminal, the overlapping portion having a third end and a fourth end, the third end being disposed on a portion of the at least one terminal between the first and second ends and spaced apart from the first and second ends, the overlapping portion extending from the third end to the fourth end in a direction away from the at least one terminal and lateral to a longitudinal axis of the at least one terminal at the third end to cover an adjacent terminal, the overlapping portion being spaced apart from the adjacent terminal, and a portion of the resin body is sandwiched between the adjacent terminal and the overlapping portion so that the overlapping portion provides a capacitor configured for eliminating noise from an electrical signal transmitted between the first device connected to the first end of each terminal and the second device connected to the second end of each terminal.

2. The connector housing according to claim 1, wherein the resin body includes a dielectric member sandwiched between the terminals at the overlapping portion, and the dielectric member has a dielectric constant, which is higher than that of the resin body.

3. The connector housing according to claim 1, wherein the at least one terminal and the adjacent terminal are disposed at different heights only inside the resin body, and the overlapping portion is disposed to be only inside the resin body.

4. The connector housing according to claim 1, wherein the overlapping portion is one of a plurality of overlapping portions, three terminals are adjacent, including the at least one terminal, the adjacent terminal, and an other terminal, and the at least one terminal and the other terminal provide two overlapping portions including the overlapping portion, the capacitor is a multi-layered capacitor, and the two overlapping portions of the three terminals are capacitor electrodes of the multi-layered capacitor.

5. The connector housing according to claim 1, further comprising:

a hollow area formed on the first surface of the resin body, the first end of each terminal being exposed at the hollow area; and an opening formed on the second surface of the resin body, the second end of each terminal being exposed at the opening.

6. The connector housing according to claim 1, wherein the direction in which the overlapping portion extends is perpendicular to the longitudinal axis of the at least one terminal, wherein the overlapping portion covers the adjacent terminal from a first side of the adjacent terminal to a second side of the adjacent terminal, the first side being proximate to the at least one terminal, the second side being opposite to the first side and distal to the at least one terminal.

7. The connector housing according to claim 6, wherein the overlapping portion has a surface between the third and fourth ends which is essentially rectangular.

8. The connector housing according to claim 6, wherein a plane of a surface of the adjacent terminal closest to the overlapping portion and between the first side and the second side is parallel to a plane of a surface of the overlapping portion between distal and proximal ends of the overlapping portion.

9. The connector housing according to claim 6, wherein the at least one terminal and the adjacent terminal are disposed at different heights only inside the resin body, and the overlapping portion is disposed only embedded in the resin body.

10. The connector housing according to claim 1, wherein the first end of each terminal is disposed at a same first height at the first surface and each terminal includes "L" shaped bends in the resin body so that the second end of each terminal is disposed to be at a same second height at the second surface, wherein the same first height is different from the same second height, wherein the at least one terminal and the adjacent terminal are disposed at different heights only inside the resin body, and between the first and second surface.

11. The connector housing according to claim 4, wherein the adjacent terminal is adjacent to the at least one terminal and the other terminal, and wherein each of the two overlapping portions cover the adjacent terminal.

12. A connector housing for electrically connecting a first device and a second device, comprising:

a resin body;

a plurality of conductive metallic terminals insert molded in the resin body, wherein a first end of each terminal is exposed at a first surface of the resin body to be connectable to the first device, and a second end of each terminal is exposed at a second surface of the resin body to be connectable to the second device; and an overlapping portion is disposed on at least one of the terminals and is unitary with the at least one terminal, the overlapping portion having a third end and a fourth end, the third end being disposed on a portion of the at least one terminal between the first and second ends and spaced apart from the first and second ends, the overlapping portion extending from the third end to the fourth end in a direction away from the at least one terminal and lateral to a longitudinal axis of the at least one terminal at the third end to cover an adjacent terminal, the overlapping portion being spaced apart from the adjacent terminal, the overlapping portion being disposed only embedded in the resin body, wherein a portion of the resin body is sandwiched between the adjacent terminal and the overlapping potion so that the overlapping portion provides a capacitor configured for eliminating noise from an electrical signal transmitted between the first device connected to the first end of each terminal and the second device connected to the second end of each terminal, wherein the overlapping portion covers a planar surface of the adjacent terminal from a first side of the adjacent terminal to a second side of the adjacent terminal, the first side being proximate to the at least one terminal, the second side being opposite to the first side and distal to the at least one terminal, wherein a plane of a surface of the adjacent terminal closest to the overlapping portion and between the first side and the second side is parallel to a plane of a surface of the overlapping potion between distal and proximal ends of the overlapping portion.

13. The connector housing according to claim 12, wherein the at least one terminal and the adjacent terminal are disposed at different heights only inside the resin body and between the first and second surface, wherein the first end of each terminal is disposed at a same first height at the first surface and each terminal includes "L" shaped bends disposed in the resin body so that the second end of each terminal is disposed to be at a same second height at the second surface, and wherein the same first height is different from the same second height.

14. The connector housing according to claim 12, wherein the resin body includes a dielectric member sandwiched between the terminals at the overlapping potion, and the dielectric member has a dielectric constant, which is higher than that of the resin body.

15. The connector housing according to claim 12, wherein the overlapping portion is one of a plurality of overlapping portions, three terminals are adjacent including the at least one terminal, the adjacent terminal, and an other terminal, and the at least one terminal and the other terminal provide two overlapping portions including the overlapping portion, the capacitor is a multi-layered capacitor, and the two overlapping portions of the three terminals are capacitor electrodes of the multi-layered capacitor.

16. The connector housing according to claim 15, wherein the adjacent terminal is adjacent to the at least one terminal and the other terminal, and wherein each of the two overlapping portions cover the adjacent terminal.

17. The connector housing according to claim 12, further comprising:

a hollow area formed on the first surface of the resin body, the first end of each terminal being exposed at the hollow area; and an opening formed on the second surface of the resin body, the second end of each terminal being exposed at the opening.

* * * * *